United States Patent [19]

Köhler et al.

[11] 3,977,663

[45] Aug. 31, 1976

[54] SKI CLAMP

[76] Inventors: Horst Köhler, Oberes Feld 13, 897 Immenstadt; Kurt Ess, Jahnstrasse 2, 8972 Sonthofen; Max Luitz, Bihlerdorf 22, 8976 Blaichach, all of Germany

[22] Filed: May 19, 1975

[21] Appl. No.: 578,884

[30] Foreign Application Priority Data

May 21, 1974 Germany ..... 17695[U]
Apr. 14, 1975 Germany ..... 2516211

[52] U.S. Cl. ..... 269/153; 269/246; 269/321 W

[51] Int. Cl.[2] ..... B25B 1/20

[58] Field of Search ..... 269/9, 10, 101, 153, 269/246, 321 W; 51/228

[56] References Cited

UNITED STATES PATENTS

| | | | |
|---|---|---|---|
| 812,699 | 2/1906 | Stevens | 269/246 |
| 2,581,317 | 1/1952 | Zabich | 269/246 |
| 2,645,962 | 7/1953 | Zähner | 269/153 |
| 3,778,048 | 12/1973 | Szohatsky | 269/321 W |
| 3,826,482 | 7/1974 | Tourangeau | 269/321 W |
| 3,854,712 | 12/1974 | McGee | 269/321 W |
| 3,861,664 | 1/1975 | Durkee | 269/153 |

FOREIGN PATENTS OR APPLICATIONS

| | | | |
|---|---|---|---|
| 359,411 | 7/1930 | United Kingdom | 269/153 |

*Primary Examiner*—Al Lawrence Smith
*Assistant Examiner*—Robert C. Watson
*Attorney, Agent, or Firm*—Dennison, Dennison, Meserole & Pollack

[57] ABSTRACT

A clamping device for attachment to a work support or table and adapted to hold a ski in either a horizontal position or on its edge in a vertical position to permit waxing, sharpening, or other finishing or repair operations. The upper face of the clamping device has both an elongated shallow tray for horizontal ski support, and a deeper and narrower U-shaped tray for vertical ski support, and a screw means is employed acting on either one or two separate movable abutments to clamp the ski within one or the other tray.

7 Claims, 7 Drawing Figures

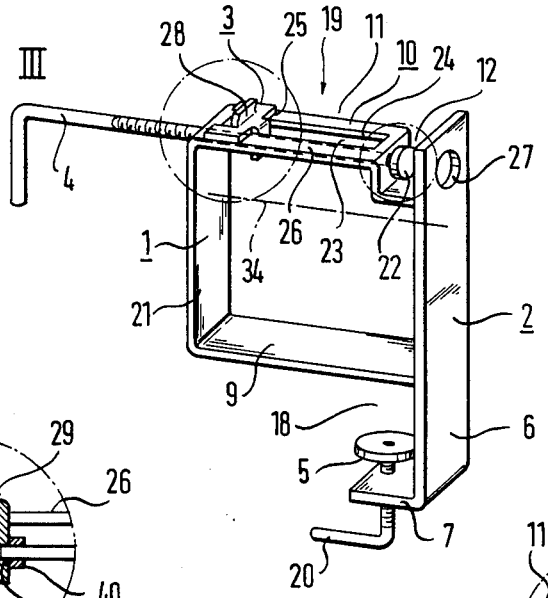
Fig.4
Fig.5
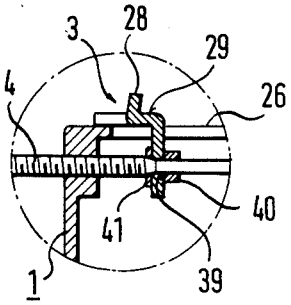
Fig.6
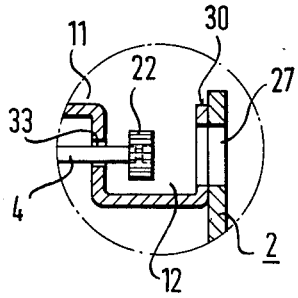
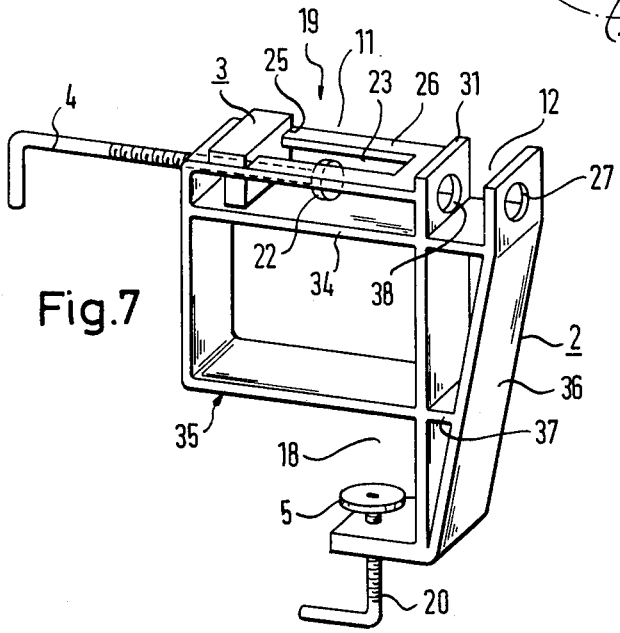
Fig.7

SKI CLAMP

The invention relates to a clamping device, especially for clamping a ski for the treatment of its surface, with a bearing portion for selective mounting support of the ski, and with a retention portion which can be fastened to a support.

As state of the art, clamping devices are already known (German DT-OS No. 2,143,861) which are used especially for sharpening the edges of a ski. This clamping device is constructed in such a way that it has at least two clamps between which a ski-securing device is provided, for example in the form of a bench vise. This clamping device holds the ski whereas in the prior art the ski rests on supports mounted on both sides of it.

The clamps consist here of simple round bracing irons, whereby one side is fastened to a support, a workbench for example, with the help of a special holding device attached to the workbench, while the other leg of the clamp can have a one or two piece form or a U-shaped holder in order to support the ski accordingly.

In every case in the prior art, however, a bench vise and a special bearing are required for each clamp in order to support the ski. Further, the known clamping devices are designed in such a way that the ski merely rests on both supports, but is not positively clamped so that for example on performing the sharpening of the steel edges of a ski, unevenness can occur in the finishing.

The result is that the prior clamping devices are very expensive to construct since they generally require three parts. Besides, they require special elements not often on hand at a workbench. Consequently, the scope of application of the known devices is considerably limited. Also in practice, disadvantages appear on use of these prior devices for clamping, since the finishing of the edges can only occur unevenly. A further disadvantage lies in the fact that an adjustment to various widths of a ski is not possible. Thus, the range of application of the known devices is severely limited.

The purpose of the present invention, in contrast, is to make a clamping device of the type mentioned above, which can be fastened in a simple manner to any support whatever, for example a table or a carpenter's bench or other platform, whereby the ski is clamped tightly and efficiently in either a vertical or horizontal position.

The objects of the invention are solved by the fact that the bearing portion has a flat tray for level clamping of the ski, an adjoining hollow U-shaped tray for vertical tight clamping of the ski, and at least one clamping element acting on the ski, and that the retention portion can be fastened directly to the support over a screw element and a block. By this structure, the advantages follow that the ski can be clamped tightly directly in the area of its supporting region; i.e., of the respective tray, so that a precise finishing of the edges or of the surfacing or of the upper side can be performed avoiding undesirable chatter noises. The trays are formed in such a way that the ski can be clamped either horizontally or upright. An additional clamping element is not required since the retention portion of the clamping device according to the invention is provided with a screw element. If one uses two clamping devices according to the invention, then these can be fastened to any plane surface in a simple manner without any previous experience, so that no additional screw element is required. The range of application of this clamping device is thereby considerably expanded.

In a further development of the invention, a common clamping element can be provided for the shallow tray and the U-shaped tray, whereby a simplified construction is provided.

According to another feature of the invention, the axis of the screw element and the horizontal plane surface of a holding angle lies with the junction plane between the two trays in a plane surface, whereby advantageously the ski can be secured in a level or upright position by manipulation of the clamping element.

In a further development of the invention, the clamping device has an angle element whereby a U-shaped element is attached to a side, of which the upper side forms the two trays and the lower side the support for the retention portion, whereby the two screw elements are fixed in the angle element. By this a very simple practical construction of the clamping device results advantageously, since this consists almost only of flat iron.

According to another feature of the invention, the U-shaped tray adjoins the one side of the angular element. Through this arrangement a very simple construction of the clamping element follows advantageously.

In another development of the invention, the shallow tray has a support by means of which it is possible to fasten the ski efficiently even in its level position.

This support can be according to another feature of the invention, a holding angle fixed in the shallow tray which further meshes into the notches, which are present in the shallow tray. By this means, it is possible to adjust the holding angle corresponding to the respective width of the ski. Consequently, a great adaptability to the respective ski width is given, so that the range of application of the clamping device is considerably expanded. According to another feature of the invention, the horizontal plane surfaces of the holding angle and the junction lie in a plane surface, whereby the ski is efficiently supported in a level position.

The holding angle, according to another feature of the invention, can be spring-stressed in one bearing which results in ease of transporting the clamping device.

In a further development of the invention, the U-shaped element is secured in notches of the one side of the angle element. By choice, the U-shaped element can be riveted or otherwise secured on to the angle element, whereby the manufacture of the clamping device is less expensive.

According to another possibility of construction, for every tray a clamping device can be provided for the ski. From this, the advantage follows that according to how the ski is to be worked on, one of the two clamping devices operates and holds the ski efficiently in the position in which it is to be treated.

According to another feature of the invention, both clamping devices are connected with each other, by which advantageously either one or the other clamping element can be brought into action by actuation of a control element.

In another development of the invention, both clamping elements can be controlled over a horizontally arranged worm-gear spindle, resulting in an especially simple operation of the two clamping elements.

In another development of the invention, the control of the two clamping elements can occur in the area above the support, whereby according to another development of the invention, the worm-gear spindle is fixed in a side of the clamping device lying above the support and can be manipulated for the ski outside of the range of processing. By this means the advantage follows that the forward side, i.e., the side which is necessary for the processing of the ski, is in any case free from the projection of clamping elements and the worm-gear spindle. The operator who processes the ski is consequently in no way prevented in his processing by the undesired protrusion of the service elements or the clamping elements.

According to another feature of the invention, the worm-gear spindle can have a disc as a clamping element for the U-shaped tray on the face side and outside the course of the thread, and a clamping angle as clamping element for the shallow tray. Both clamping elements are consequently simply constructed parts, which however hold the ski functionally secure in every case in its tightly clamped position, whether a cross country ski, a child's ski, a downhill run ski, or another special ski is to be worked on.

In another development of the invention, the disc can be formed of a synthetic material and be freely pivoted on the face side of the worm-gear spindle. By this means, protection of the tightly clamped ski is provided so scratching of the surface of the ski is effectively avoided.

In a further development of the invention, the clamping angle can be controlled in the clamping device, whereby an acceptable control of the sliding movement of the clamping angle is ensured.

For carrying out this sliding movement of the clamping angle in another development of the invention, a horizontal side of the clamping device can have an oblong hole, the side surfaces of which run lengthwise and support the clamping angle.

According to another feature of the invention, the clamping angle can be provided with lateral recesses running parallel to the sliding direction, which are formed in lateral cross pieces of the horizontal side of the clamping device. By means of these recesses, a counter-holding is achieved which serves to relieve the worm-gear spindle and serves as a stabilizer for the clamping element. Advantageously, a very stable construction of the clamping element results from this construction.

According to another feature of the invention, a vertical side of the clamping device which forms the support for the horizontal clamping of the ski can have a slot for carrying the disc mounted on the worm-gear spindle, whereby it is possible to securely clamp every model of ski in an upright position efficiently and whereby even a horizontal clamping of the ski can be carried out on the other hand, regardless of what width the ski may have. The worm-gear spindle and the disc in no way prevent the horizontal clamping of the ski.

In another development of the invention, the clamping angle can have a clamping jaw which is diagonally inclined forward, whereby a secure bracing of the ski is ensured.

According to another feature of the invention, a contact surface for the ski can be attached to the clamping jaw, whereby the vertical side of the clamping device is provided with a supporting edge, which is on the same level as the contact surface of the clamping jaw. Consequently an acceptable support of the ski in a horizontal position results so that proper finishing is ensured in every case.

According to another feature of the invention, between the shallow tray and the U-shaped tray a fitting edge is provided, which is on the same level as the clamping angle. By this means even extremely narrow skis can be worked on efficiently.

According to another feature of the invention, a U-shaped element is fixed onto the vertical side, the upper side of which forms the horizontal side of the clamping device between the two trays, and the lower side of which is the support for the retention portion. Hereby, an especially simple form of construction of the invention results, since once more only commercial flat iron sheets are required for the manufacture of this form of construction of the clamping device according to the invention.

According to another feature of the invention, both sides of the U-shaped tray are each provided with an opening, whereby the one opening serves for passage of the forward part of the worm-gear spindle and the other opening serves for passage of the disc fastened on the face side of the worm-gear spindle.

According to another feature of the invention, a bracing rib is mounted between the two sides of the U-shaped element of the clamping device, whereby a system which is especially resistant to bending is achieved.

In a further development according to the invention, it is also possible to produce the entire clamping device from a profile line, whereby for example the profile line can also have additional bracing ribs.

The invention is described in greater detail with the aid of drawings of the forms of construction displayed. In the drawings:

FIG. 4 shows a perspective view of another form of construction of the clamping device according to the invention;

FIG. 5 shows an enlarged side view of the range of the clamping angle of the form of construction according to FIG. 4;

FIG. 6 shows an enlarged side view in the section of the U-shaped tray according to the form of construction in FIG. 4; and FIG. 7 shows yet another form of construction in perspective of the clamping device according to the invention.

Figure 1:
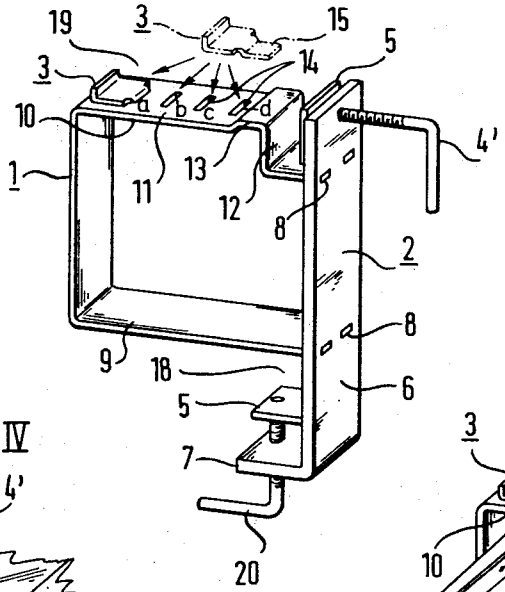
FIG. 1 shows a perspective view of a preferred form of construction of the clamping device according to the invention.

The clamping device consists essentially of a U-shaped element 1 according to FIG. 1, which is secured within notches 8 of an angle element 2. This angle element 2 has a screw member 4' on the side 6 in the upper area and a second screw element 20 on the side 7 which is perpendicular to side 6. Each of the two screw elements 4' and 20 has a pressure plate 5 or a revolving pressure disc on their inner ends.

The upper side 10 of the U-shaped member 1 forms the shallow tray 11 and a deeper U-shaped tray 12. Between the shallow tray 11 and the U-shaped tray 12, a junction 13 is present. On the outer side of the shallow tray 11 there is a holding angle 3 which can engage various notches 14 with its catch 15 according to the width of the ski to be worked on, which is arranged in the area of the shallow tray 11.

In FIG. 1, the separate notches serve to mount the catch 15. It is possible, therefore, to work on a cross country ski or a jumping ski, which have very different widths. It is only necessary to remove the holding angle 3 from one notch 14 and insert it into another notch. The level of the holding angle 3 and the level of the junction 13 are such that both lie on a common level.

The U-shaped element 1 has a lower arm or side 9 which serves as support for the retention portion 18 which is stressed from the pressure plate 5 of the screw element 20. Through this it is possible by way of example to secure the clamping device on any surface whatever. Only by corresponding adjustment of the screw element 20 on the thickness of the platform can the clamping device be clamped on the corresponding platform, which is in the retention portion 18.

Figure 2:
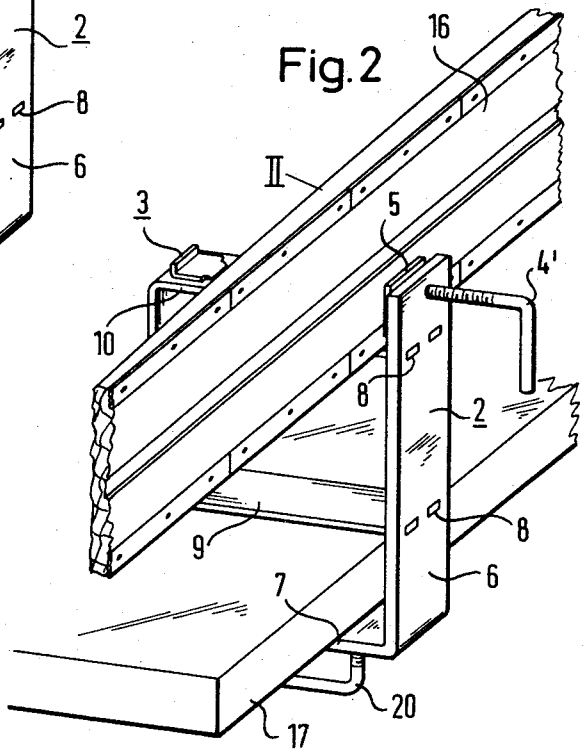
FIG. 2 shows the application of the clamping device for tightly clamping of a ski in an upright position.

In FIG. 2, it is shown how the clamping device is mounted on a foundation 17. This foundation 17 is arranged here in the retention portion 18 and is between the side 9 and the pressure plate 5 of the screw element 20.

In FIG. 2 it is further shown that the clamping device is provided for installation of a ski in the U-shaped tray 12. The ski 16 is thereby in the position II, and is therefore upright. Hereby the ski 16 rests in the U-shaped tray 12 and is tightly adjusted between the one wall of the junction 13 and the pressure plate 5 of the screw element 4' whereby bracing takes place with the aid of the aforesaid screw element 4'.

Figure 3:
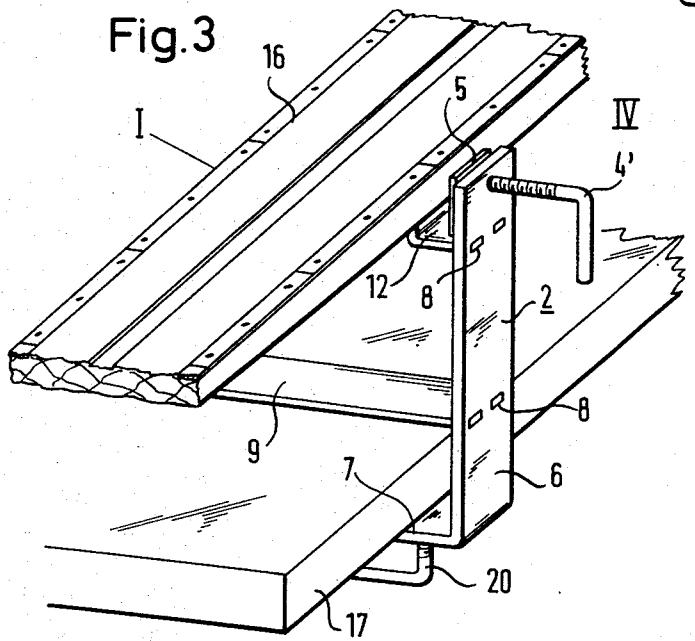
FIG. 3 shows the application of the clamping device for horizontal or level positioning of the ski.

If the ski is to be placed in the flat tray 11, then the screw element 4' is released and the ski is set in the shallow tray 11 wherein it is located between the holding angle 3 and the pressure plate 5 of the screw element 4'. Again it is tightly clamped with the aid of this screw element 4' as shown in FIG. 3.

Thus, it is possible with the help of the clamping device to firmly clamp a ski of any length either in position II or in position I efficiently on any support surface whatsoever. The holding angle 3 can be adjusted to the corresponding width of the ski so that all types of skis presently in use can be engaged. With the help of this clamping device, it is consequently possible to work on the ski in every manner desired, i.e., for example to finish the edges by sharpening or filing, to remove the surfacing, to wax the ski or to repair any damaged places in every area of the ski.

In the case of the form of construction according to FIG. 4, the clamping device again consists essentially of the U-shaped element 1, which is fastened on the vertical side 2, i.e., on the previously mentioned angle element. The U-shaped element 1 has a lower side 9 and an upper side 10 which are both attached to the vertical side 2. The upper side 10 has a shallow tray 11 for horizontal mounting of a ski and an adjoining U-shaped trough 12 for vertical support of a ski during its processing.

For tightly clamping skis in the tray 11 or 12, separate clamping elements are provided. For tightly clamping the ski in the shallow tray 11, the clamping angle 3, a modified form of the holding angle according to FIG. 1, is used, whereas for tightly clamping the ski in the U-shaped tray 12 a disc 22 is provided.

The disc 22 and the clamping angle 3 are in each case mounted on a worm-gear spindle 4 which passes parallel to the upper side 10 of the U-shaped element. This worm-gear spindle 4 is supported in the U-shaped element 1.

The actuating part of the worm-gear spindle 4 projects into an area III which is above a support, not shown in detail. It will be noted that side 10 is kept completely free so that the top surface is not impaired by the projection of the worm-gear spindle 4 during the processing of the ski in its horizontal or upright position. A basic difference compared with form of construction according to FIGS. 1 to 3 may be seen wherein the actuating element 4' is mounted according to FIGS. 2 and 3 on side 2 so that by way of example, it may interfer with an operator during the processing of the ski. According to FIGS. 4 and 7, the actuating part of the worm-gear spindle 4 is in an area above a support 17 (FIGS. 2 and 3) so that the processing side is completely free and the operator is not hindered by it during his processing of the ski.

According to FIG. 6, the disc 22 is attached to the face side of the worm-gear spindle 4. The disc 22 preferably is formed of synthetic plastic and advantageously is pivoted freely on the face side of the worm-gear spindle 4. In the middle area, the clamping angle 3 is arranged to pivot freely on the worm-gear spindle according to FIG. 5.

This clamping angle 3 is according to FIG. 4 captured in a slot 23 of the upper side 10. The clamping angle has three lateral notches which cross over the cross pieces 26 of the upper side 10. This provides further control of the clamping angle in its movement along the lateral surfaces 24 of the slot 23. Consequently, an efficient control of the clamping angle is ensured.

This clamping angle 3 has according to FIG. 5, a clamping jaw 28 which is obliquely bent forwardly and a contact surface 29. The contact surface 29 is on the same level as a supporting edge 30 represented in FIG. 6 in the area of the vertical side 2. This vertical side 2 is provided with an opening 27 whereby for example the disc 22 can pass through the opening 27 if an extremely narrow ski is to be clamped securely in a horizontal position in the area of the shallow tray 11 according to FIG. 4. It will be apparent that the ski lies on the contact surface 29 of the clamping angle 3 according to FIG. 5, and according to FIG. 6 on the supporting edge 30 and is pressed against the vertical side 2 by the clamping jaw 28 which is bent forward.

In the case of the extremely narrow ski, the disc 22 passes through the opening 27 in the case that the clamping angle 3 is pushed very far to the right according to FIG. 4. According to FIG. 6, the U-shaped tray 12 has an opening 27 for the passage of the forward part of the worm-gear spindle on the right side. This opening 27 lies coaxially to the opening 33 for the worm-gear spindle 4.

For increasing the bending resistance of the entire arrangement, a bracing rib 34 according to FIG. 4 can be provided between the side 21 of the U-shaped element 1 and the vertical side 2.

In FIG. 7, another form of construction of the invention is represented. This form of construction shows a clamping device which is manufactured from a profile line 35. In this connection again bracing ribs 34, 36, and 37 can be provided. In the upper area this form of construction of the clamping device has a fitting edge 31 between the shallow tray 11 and the U-shaped tray 12 which serves as a support for the slidable clamping angle 3.

This clamping angle 3 again has lateral recesses which are directed in the cross pieces 26 of the slot 23. The clamping angle 3 is fastened so it can be freely slidable outside of the screw range of the worm-gear spindle 4. The worm-gear spindle 4 likewise has on the face side a disc 22 which can be rotated freely and which is advantageously made of plastic material. In the case of this form of construction, two coaxial openings 27 and 38 are provided, through which the disc 22 can pass. In this conection, extremely narrow skis can also be tightly clamped in a horizontal position, since the range of the clamping of the shallow tray 11 extends from zero to the end of the slot 23. Thus, for example, in the case of horizontal clamping of extremely narrow skis, the disc 22 passes through the opening 38 as well as through the opening 27, whereby the clamping angle 3 is very near the fitting edge 31.

If a ski is to be clamped in the U-shaped tray 12 in an upright position, then the disc 22 comes into the range of the U-shaped tray 12 and braces the ski inside of the U-shaped tray 12 with assitance from the worm-gear spindle 4, whereby the vertical side 2 serves as a support. In the case of this form of construction which is produced from a profile line 35, a bearing portion 18 results with the pressure plate 5 and the screw element 20 as well as with the bearing portion 19 with the two trays 11 and 12 as well as the two clamping elements 3 and 22.

In the case of these forms of construction also, the side 10 is completely free from projection of the worm-gear spindle 4, so that the person who processes the ski either in the horizontal or the vertical position is not hindered in this processing.

The clamping angle 3 shown in FIGS. 4, 5 and 6 has a borehole 39 according to FIG. 5, through which the worm-gear spindle not provided with thread is passed. The clamping angle 3 is secured on both sides by holding elements 40 and 41 against undesired sliding. Thereby on the rotation of the worm-gear spindle inside its mounting in the side 21, the clamping angle 3 either moves to the right or to the left and is guided by means of the lateral recesses 25 received in the cross pieces, whereby a release for the worm-gear spindle 4 is ensured through this guidance when the clamping angle 3 presses the ski against the stationary support 2 or 31.

It therefore follows that a functionally correct mounting of the ski either in the horizontal or vertical position results from the clamping device according to the invention, whereby the ski is held by a clamping angle 3 or the disc 22.

We claim:

1. A clamping device for clamping a ski for working on its different surfaces comprising a bearing portion for selective mounting thereon of a ski in either a horizontal or vertical position and a retention portion for fastening said device to a work table or other support, said bearing portion including a horizontally disposed member having a shallow elongated tray for horizontal ski clamping and an adjacent deeper U-shaped tray for vertical ski clamping, stationary abutment means associated with each tray, separate movable abutment means for each of said shallow and U-shaped trays acting in cooperation with said stationary abutment means, and screw means for moving each of said movable abutment means toward and away from said stationary abutment means for clamping a ski therebetween in either said shallow tray or said U-shaped tray, said movable abutment means being mounted on said screw means and said retention portion having a clamp for securing the device to a support, the body of said device being formed of a vertical face member having an inturned flange at its lower end, and a U-shaped frame member joined at its free ends to said vertical face member to define a rectangular opening therebetween, said horizontally disposed member constituting the upper arm of said U-shaped member, said screw means being mounted in the bight portion of said U-shaped member thereby presenting no obstruction to the user.

2. A clamping device as defined in claim 1 wherein the free end of the screw means has a disc affixed thereto which serves as the movable abutment for said U-shaped tray.

3. A clamping device as defined in claim 2, wherein said disc is freely and rotatably mounted on the screw means and is formed of a synthetic plastic material.

4. A clamping device as defined in claim 3 wherein the horizontally disposed member is formed in the area of the shallow tray of two side rails located above the axis of said screw means, said movable abutment for the shallow tray being supported on said side rails and having a depending portion carried by said screw means.

5. A clamping device as defined in claim 2 wherein said vertical face member has an opening (27) therein adapted to allow said disc to pass freely therethrough.

6. A clamping device as defined in claim 5 wherein a ski supporting edge support (30) is provided on the inner surface of the face member and below the top surface thereof.

7. A clamping device for clamping a ski for working on its surface comprising a bearing portion for selective mounting thereon of a ski in either a horizontal or vertical edge position and a retention portion for fastening said device to a work table or other support, said bearing portion including a horizontally disposed member having a shallow elongated tray for horizontal ski clamping and an ajoining deeper U-shaped tray for vertical ski clamping, stationary abutment means associated with each tray, separate movable abutment means for each of said shallow and U-shaped trays acting in cooperation with said stationary abutment means, and screw means for moving said movable abutment means toward and away from said stationary abutment means for clamping a ski therebetween in either said shallow tray or said U-shaped tray, said retention portion having a clamp for securing the device to a support, and a fitting edge member upstanding between said shallow tray and said U-shaped tray, the upper surface of which is essentially coplanar with the upper surface of said movable abutment means for said shallow tray.

* * * * *